US012428928B2

(12) United States Patent
Dubost et al.

(10) Patent No.: US 12,428,928 B2
(45) **Date of Patent: *Sep. 30, 2025**

(54) PROCESSES FOR INJECTION OF FLUIDS INTO A WELLBORE VIA DRILL PIPE

(71) Applicant: Schlumberger Technology Corporation, Sugar Land, TX (US)

(72) Inventors: Francois-Xavier Dubost, Paris (FR); Magdy Samir Osman, Bucharest (RO); Ashers Partouche, Katy, TX (US); Morten Kristensen, Lysaker (NO); Hadrien Dumont, Paris (FR); Adriaan Gerard Gisolf, Bucharest (RO)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/935,061

(22) Filed: Nov. 1, 2024

(65) Prior Publication Data

US 2025/0059847 A1 Feb. 20, 2025

Related U.S. Application Data

(63) Continuation of application No. 18/069,365, filed on Dec. 21, 2022, now Pat. No. 12,134,949.

(51) Int. Cl.
*E21B 33/124* (2006.01)
*E21B 17/02* (2006.01)
(Continued)

(52) U.S. Cl.
CPC ..... *E21B 33/124* (2013.01); *E21B 17/021* (2013.01); *E21B 17/023* (2013.01);
(Continued)

(58) Field of Classification Search
CPC ..... E21B 47/11; E21B 47/10; E21B 47/117; E21B 49/10; E21B 49/0875;
(Continued)

(56) References Cited

U.S. PATENT DOCUMENTS 3,765,484 A 10/1973 Hamby
4,658,916 A 4/1987 Bond
(Continued)

FOREIGN PATENT DOCUMENTS

EP 2268890 A2 1/2011
EP 2964873 B1 12/2019
(Continued)

OTHER PUBLICATIONS

Office Action issued in U.S. Appl. No. 18/572,225 dated Mar. 18, 2025, 27 pages.
(Continued)

*Primary Examiner* — Daniel P Stephenson
(74) *Attorney, Agent, or Firm* — Jeffrey D. Frantz

(57) ABSTRACT

Processes for injection of fluids into a wellbore via drill pipe. In some embodiments, the process can include positioning a downhole apparatus on a drill pipe. The process can also include placing the downhole apparatus at a desired station depth within a wellbore. The process can also include attaching a cable to the downhole apparatus from an up-hole environment. The process can also include setting at least one packer to seal a space between at least a portion of the downhole apparatus and an inner surface of the wellbore. The process can also include introducing a fluid to the downhole apparatus through the drill pipe and using a pump to inject at least a portion of the fluid into a geological stratum.

20 Claims, 8 Drawing Sheets

(51) Int. Cl.

| | |
|---|---|
| ***E21B 23/06*** | (2006.01) |
| ***E21B 33/122*** | (2006.01) |
| ***E21B 47/11*** | (2012.01) |
| ***E21B 49/00*** | (2006.01) |
| ***E21B 49/08*** | (2006.01) |

(52) U.S. Cl.
CPC ..... *E21B 23/06* (2013.01); *E21B 33/122* (2013.01); *E21B 47/11* (2020.05); *E21B 49/008* (2013.01); *E21B 49/083* (2013.01)

(58) Field of Classification Search
CPC .... E21B 49/008; E21B 33/122; E21B 33/126; E21B 33/124
See application file for complete search history.

(56) References Cited

U.S. PATENT DOCUMENTS

| | | | | |
|---|---|---|---|---|
| 5,269,180 | A | 12/1993 | Dave | |
| 7,270,179 | B2 | 9/2007 | Mansuy | |
| 8,122,966 | B2 | 2/2012 | Kelley | |
| 8,528,394 | B2 | 9/2013 | Eriksen | |
| 8,905,130 | B2 | 12/2014 | Landsiedel | |
| 11,624,279 | B2 | 4/2023 | Hudson | |
| 12,134,949 | B2 * | 11/2024 | Dubost | E21B 17/023 |
| 2007/0000663 | A1 | 1/2007 | Kelley | |
| 2007/0162235 | A1 | 7/2007 | Zhan | |
| 2009/0159275 | A1 | 6/2009 | Kannan | |
| 2010/0050762 | A1 | 3/2010 | Nold, III | |
| 2010/0206548 | A1 | 8/2010 | Pisio | |
| 2010/0242586 | A1 | 9/2010 | Elshahawi | |
| 2010/0319912 | A1 | 12/2010 | Pop | |
| 2012/0150515 | A1 | 6/2012 | Hariharan | |
| 2016/0003026 | A1 | 1/2016 | Adams | |
| 2016/0265329 | A1 | 9/2016 | Badri | |
| 2017/0044877 | A1 | 2/2017 | Salino | |
| 2018/0003047 | A1 | 1/2018 | Sharma | |
| 2018/0171788 | A1 | 6/2018 | Waid | |
| 2019/0128117 | A1 | 5/2019 | Dumont | |
| 2021/0363883 | A1 | 11/2021 | Jones | |
| 2022/0243588 | A1 | 8/2022 | Hudson | |
| 2024/0209728 | A1 | 6/2024 | Dubost | |
| 2025/0059847 | A1 * | 2/2025 | Dubost | E21B 33/124 |

FOREIGN PATENT DOCUMENTS

| | | | |
|---|---|---|---|
| WO | 2008100156 | A1 | 8/2008 |
| WO | 2009058980 | A2 | 5/2009 |
| WO | 2013043836 | A1 | 3/2013 |
| WO | 2020117219 | A1 | 6/2020 |
| WO | 2021006930 | A1 | 1/2021 |
| WO | 2022271785 | A1 | 12/2022 |

OTHER PUBLICATIONS

Extended Search Report issued in European Patent Application No. 22829201.7 dated Apr. 14, 2025, 6 pages.
International Search Report and Written Opinion issued in the PCT Application PCT/US2022/034459, dated Oct. 4, 2022 (12 pages).
Office Action issued in U.S. Appl. No. 18/069,365 dated Mar. 28, 2024, 15 pages.
Extended Search Report issued in European Patent Application No. 23307314.7 dated Jul. 2, 2024, 8 pages.
Jackson, R. et al., "Enabling Technologies for Dynamic Reservoir Evaluation and Extended Pressure Transient Testing for the Low Carbon Transition", SPWLA 63rd Annual Logging Symposium, Jun. 10-15, 2022, 15 pages.
Office Action issued in U.S. Appl. No. 18/572,225 dated Dec. 5, 2024, 19 pages.

* cited by examiner

PROCESSES FOR INJECTION OF FLUIDS INTO A WELLBORE VIA DRILL PIPE

CROSS-REFERENCE TO RELATED APPLICATION

This application is a continuation of U.S. patent application Ser. No. 18/069,365, entitled: Process for Injection of Fluids into a Wellbore via Drill Pipe, which was filed on Dec. 21, 2022. The foregoing application is incorporated in its entirety by reference.

FIELD

Embodiments described generally relate to injection of fluids into a wellbore. More particularly, such embodiments relate to processes for injection of fluids into a wellbore via a drill pipe and a downhole apparatus. Embodiments also relate to a process to enable flushing a near wellbore region with a fluid, thereby displacing native fluids so that evaluation of the nearby geological stratum can be tested. This displacement of the native fluids produces both a sweeping effect and a residual saturation for the geological stratum that may be measured. Embodiments also provide for circulation of fluid down in a wellbore with injection in the formation, rather than the wellbore.

BACKGROUND

Proper testing of wellbore environments can provide many advantages to engineers and operators. Some of the most important information can be derived from injection processes for some types of wellbores. In some instances, geological stratum can allow injection of fluids such as gases, liquids, acids, caustics, and other materials into the formation. The injection of such materials into a wellbore can facilitate certain advantages in the downhole environment.

In one example, an injection well can be located near a production well that is used to recover hydrocarbons. After a certain amount of time, the production well can start to lose economic viability as the pressure head within the wellbore of the production well decreases. For one to be able to recover a greater quantity of hydrocarbons from the production well, artificial lift procedures can be used to increase the amount of recoverable hydrocarbons from areas adjacent to the production well. While these procedures may have certain advantages, there are some limitations for such activities. For example, production wells can only provide a certain amount of lift within a wellbore. After this amount of lift is achieved, any remaining hydrocarbons within the areas around the production well will not be recovered, limiting the overall economic viability of the wellbore. For one to be able to increase the amount of hydrocarbons recovered from the geological stratum, in some instances, an injection well is created where the materials previously mentioned can be injected into the geological stratum thereby pushing hydrocarbons from the injection well toward the production well. This gradual forcing of hydrocarbons from the injection well to the production well can greatly increase the quantity of hydrocarbons recovered in the production well. Conventional techniques used to determine injectivity of a geological stratum are often haphazard and rudimentary.

There is a need; therefore, to be able to determine features of the geological stratum that can assist operators and engineers in recovering hydrocarbons from wellbores where injection processes are used. There is also a further need to provide cost-effective measures for performing injection techniques and hydrocarbon recovery from production wells that are superior to conventional techniques. There is a further need to provide processes and apparatus that are easy to use and understand for field personnel and that can utilize equipment not previously used in injection techniques in geological stratum. There is also a need to understand the geomechanics involved with the injection techniques such that different properties may be measured, such as the geological sweeping effect during fluid injection periods, as well as residual saturation. There is a still further need to be able to measure these properties in different types of wellbores, such as an open hole wellbore and cased hole wellbore.

SUMMARY

Processes for injection of fluids into a wellbore are provided. In some embodiments, the process can include positioning a downhole apparatus on a drill pipe. The process can also include placing the downhole apparatus at a desired station depth within a wellbore. The process can also include attaching a cable to the downhole apparatus from an up-hole environment. The process can also include setting at least one packer to seal a space between at least a portion of the downhole apparatus and an inner surface of the wellbore. The process can also include introducing a fluid to the downhole apparatus through the drill pipe. The process can also include using a pump from the downhole apparatus or a pump located at a surface of the earth to inject at least a portion of the fluid from the downhole apparatus into a geological stratum at the desired station depth.

In other embodiments, the process can include positioning a downhole apparatus on a drill pipe. The process can also include placing the downhole apparatus at a desired station depth within a wellbore. The process can also include attaching a cable to the downhole apparatus from an up-hole environment. The process can also include setting two packers longitudinally spaced apart from one another on the downhole apparatus to provide a sealed volume between the downhole apparatus and an inner surface of the wellbore. The sealed volume can include a drilling mud disposed therein. The process can also include introducing a first fluid to the downhole apparatus through the drill pipe. The process can also include using a pump from the downhole apparatus or a pump located at a surface of the earth to inject at least a portion of the first fluid from the downhole apparatus into the sealed volume. The process can also include flowing at least a portion of the drilling mud from the sealed volume into the downhole apparatus. The process can also include introducing the at least a portion of the drilling mud into the wellbore at a location located between a surface of the earth and the packer closest to the surface of the earth such that the sealed volume contains less drilling mud disposed therein.

In other embodiments, the process can include a downhole apparatus on a drill pipe. The process can also include placing the downhole apparatus at a desired station depth within a wellbore. The process can also include attaching a cable to the downhole apparatus from an up-hole environment. The process can also include setting two packers longitudinally spaced apart from one another on the downhole apparatus to provide a sealed volume between the downhole apparatus and an inner surface of the wellbore. The sealed volume can include a drilling mud, a formation fluid, or a mixture thereof disposed therein. The process can also include using a pump from the downhole apparatus to inject at least a portion of a first fluid from the downhole apparatus into the sealed volume. The first fluid can be obtained from a chamber of the downhole apparatus that contains the first fluid. The process can also include flowing at least a portion of the drilling mud, the formation fluid, or the mixture thereof from the sealed volume into the downhole apparatus. The process can also include introducing the at least a portion of the drilling mud, the formation fluid, or the mixture thereof into the wellbore at a location located between a surface of the earth and the packer closest to the surface of the earth such that the sealed volume contains less of the drilling mud, the formation fluid, or the mixture thereof disposed therein.

In another example embodiment, a process is disclosed. The process may comprise placing the downhole apparatus at a desired station depth within a wellbore. The process may also comprise attaching a cable to the downhole apparatus from an up-hole environment. The process may also comprise performing a first test of a saturation level of geological stratum at the desired station depth. The process may further comprise setting a dual packer to seal a space between at least a portion of the downhole apparatus and an inner surface of the wellbore. The process may further comprise introducing a fluid to the downhole apparatus through the drill pipe. The process may also comprise circulating at least a portion of the fluid through a first line from a circulating sub to a bottom outlet. The process may also comprise creating a suction in a dual packer interval from an upper inlet into a secondary flowline. The process may further comprise replacing at least a portion of fluid from the dual packer interval with the portion of the circulated fluid. The process may also comprise using a pump to inject at least a portion of the fluid from the downhole apparatus into a geological stratum at the desired station depth. The process may also comprise performing a second test of the saturation level of geological stratum at the desired depth. The process may also comprise determining a change in the saturation level from the first test to the second test.

In another embodiment, a process is described. The process may comprise positioning a downhole apparatus on a drill pipe. The process may further comprise placing the downhole apparatus at a desired station depth within a wellbore. The process may further comprise attaching a cable to the downhole apparatus from an up-hole environment. The process may further comprise performing a first geological stratum test at the desired station depth. The process may further comprise setting a dual packer to seal a space between at least a portion of the downhole apparatus and an inner surface of the wellbore. The process may further comprise introducing a fluid to the downhole apparatus through the drill pipe, wherein the fluid includes both a drill fluid and one of a fresh water volume and a brine volume, the one of the fresh water volume and the brine volume in a pill. The process may also comprise circulating at least a portion of the fresh water volume and the brine volume through a first line from a circulating sub to a bottom outlet. The process may also comprise creating a suction in a dual packer interval from an upper inlet into a secondary flowline. The process may also comprise replacing at least a portion of fluid from the dual packer interval with the portion of fresh water volume and brine volume. The process may also comprise using a pump to inject at least a portion of the fluid from the downhole apparatus into a geological stratum at the desired station depth. The process may also comprise performing a second geological stratum test at the desired station depth and determining a change from the first test to the second test.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the drawings. It is to be noted; however, that the appended drawings illustrate only typical embodiments of this disclosure and are therefore not to be considered limiting of its scope, for the disclosure may admit to other equally effective embodiments. It is contemplated that elements disclosed in one embodiment can be utilized in other embodiments without specific recitation.

DETAILED DESCRIPTION

Figure 1:
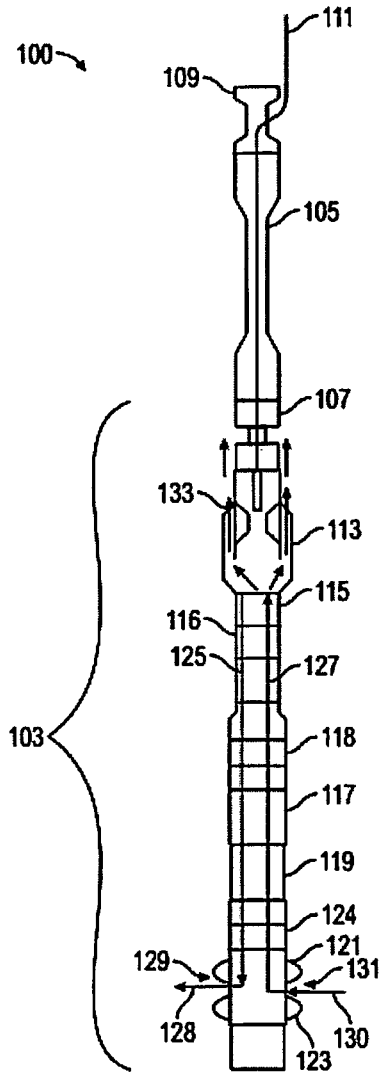
FIG. 1 depicts an illustrative downhole assembly that includes an illustrative downhole apparatus configured to carry out a first operation, according to one or more embodiments described.

In the following, reference is made to embodiments of the disclosure. It should be understood; however, that the disclosure is not limited to specific described embodiments. Instead, any combination of the following features and elements, whether related to different embodiments or not, is contemplated to implement and practice the disclosure. Furthermore, although embodiments of the disclosure may achieve advantages over other possible solutions and/or over the prior art, whether or not a particular advantage is achieved by a given embodiment is not limiting of the disclosure. Thus, the following aspects, features, embodiments, and advantages are merely illustrative and are not considered elements or limitations of the claims except where explicitly recited in a claim. Likewise, reference to "the disclosure" shall not be construed as a generalization of inventive subject matter disclosed herein and should not be considered an element or limitation of the claims except where explicitly recited in a claim.

Although the terms first, second, third, etc., may be used herein to describe various elements, components, regions, layers, and/or sections, these elements, components, regions, layers, and/or sections should not be limited by these terms. These terms may be only used to distinguish one element, component, region, layer or section from another region, layer, or section. Terms such as "first", "second" and other numerical terms, when used herein, do not imply a sequence or order unless clearly indicated by the context. Thus, a first element, component, region, layer, or section discussed herein could be termed a second element, component, region, layer, or section without departing from the teachings of the example embodiments.

When an element or layer is referred to as being "on", "engaged to", "connected to", or "coupled to" another element or layer, it may be directly on, engaged, connected, coupled to the other element or layer or one or more intervening elements or layers may be present. In contrast, when an element is referred to as being "directly on", "directly engaged to", "directly connected to", or "directly coupled to" another element or layer, there may be no intervening elements or layers present. Other words used to describe the relationship between elements should be interpreted in a like fashion. As used herein, the term "and/or" includes any and all combinations of one or more of the associated listed terms.

Some embodiments will now be described with reference to the figures. Like elements in the various figures will be referenced with like numbers for consistency. In the following description, numerous details are set forth to provide an understanding of various embodiments and/or features. It will be understood; however, by those skilled in the art, that some embodiments may be practiced without many of these details, and that numerous variations or modifications from the described embodiments are possible. As used herein, the terms "above" and "below", "up" and "down", "upper" and "lower", "upwardly" and "downwardly", and other like terms indicating relative positions above or below a given point are used in this description to more clearly describe certain embodiments.

FIG. 1 depicts an illustrative downhole assembly 100 that includes an illustrative downhole apparatus 103 configured to carry out a first operation, according to one or more embodiments. In some embodiments, the downhole assembly 100 can include, but is not limited to, the downhole apparatus 103, a drill pipe 105, and a side entry sub 109. In some embodiments, the downhole apparatus 103 can be positioned or otherwise connected to a first end of the drill pipe 105 via a slip joint or other connection 107. The side entry sub 109 can be connected to a second end of the drill pipe 105. The drill pipe 105 can include any number of sections of pipe connected together with the number of connected pipes configured to locate the downhole apparatus 103 at a desired station depth within a wellbore. In some embodiments, the downhole apparatus 103 can be a wireline tool configured to connect to the drill pipe 105. In some embodiments, a suitable wireline tool can include the Ora™ intelligent wireline formation testing tool available from SLB.

In some embodiments, once the downhole assembly 100 has been at least partially located into the wellbore, a wireline cable 111 can be fed into the side entry sub 109 and into a flow path of the drill pipe 105 and can be pumped or otherwise conveyed down and connected, e.g., via a wet connector, to the downhole apparatus 103. The wireline cable 111 can, among other capabilities, be configured to transmit power to the downhole apparatus 103 and/or transmit and receive data to and from the downhole apparatus 103. The downhole assembly 100, after being located within the wellbore at a first desired station depth and carrying out one or more operations, can be moved further into the wellbore to move the downhole assembly 100 to a second station depth and so on by connecting one or more additional sections of pipe while the additional length of wireline cable 111 can remain outside the additional section(s) of pipe.

In some embodiments, the downhole apparatus 103 can include a circulation sub 113, at least one pump, two are shown, 117 and 119, and at least one packer, two are shown, 121, 123. The first and second packers 121, 123 can be longitudinally spaced apart from one another on the downhole apparatus 103 such that when the downhole apparatus 103 is located within the wellbore and the packers 121, 123 have been set, the set packers 121, 123 can provide a sealed volume therebetween. In some embodiments, the downhole apparatus 103 can also include a chamber 118 that can be configured to store fluid that can be injected into the wellbore via the downhole tool 103. In some embodiments, the downhole apparatus 103 can also include a fluid analyzer 115. In some embodiments, the downhole apparatus 103 can also include a power module 116 configured to provide power to the downhole apparatus 103. In some embodiments, the downhole apparatus 103 can also include a packer valve block and electronics assembly 124 configured to move the packers 121, 123 between a closed or unset position and an open or set position.

Two or more flow paths, two are shown, 125, 127 can be disposed within the downhole apparatus 103. In some embodiments, the first pump 117 can be configured to convey a fluid, e.g., a gas and/or a liquid, through the first flow path 125 and the second pump 119 can be configured to convey a fluid, e.g., a gas and/or a liquid, through the second flow path 127. The first and second pumps 117, 119 can be bi-directional pumps that can convey fluids in either direction through the first and second flow paths 125, 127, respectively. In other embodiments, the first pump 117 and/or the second pump 119 can be placed in a bypass mode and one or more pumps located at a surface of the earth can be used to convey the fluid through the first flow path 125 and/or the second flow path 127. In still other embodiments, one of the first and second pumps 117, 119 can be used to convey the fluid through one of the first flow path 125 and the second flow path 127 and a pump located at the surface of the earth can be used to convey the fluid through the other of the first flow path 125 and the second flow path 127.

The direction a fluid can be conveyed through the first and second flow paths 125, 127 can depend on the operation being carried out with the downhole apparatus 103. It should be understood that the first flow path 125 and/or the second flow path 127 can include a single flow path/flow line or two or more separate flow paths/flow lines that can convey a fluid therethrough. It should also be understood that the fluid(s) that can be conveyed through the first flow path 125 and/or the second flow path 127 can include solids that can be slurried, suspended, dispersed, or otherwise disposed within the fluid(s).

In some embodiments, when a fluid is desired to be introduced into the first flow path 125, the fluid can be introduced via the drill pipe 105 to the downhole apparatus 103. In some embodiments, the fluid can flow through a flow path defined by the drill pipe 105. In other embodiments, the fluid can flow through a coiled tube disposed within the flow path defined by the drill pipe 105. In some embodiments, the fluid analyzer 115 can be used to detect the presence of the fluid within the downhole apparatus 103. The fluid analyzer 115 can detect any one or more of a number of properties of the fluid. In some embodiments, the fluid analyzer 115 can include a spectrometer, fluorescence, resistivity, viscosity, and/or density sensors, pressure and temperature gauges, or any combination thereof. In some embodiments, once the at least one packer 121 and/or 123 has been set and the fluid has been detected by the fluid analyzer 115, at least a portion of the fluid can be introduced from the downhole apparatus 103 and into a wellbore the downhole apparatus can be located within. In other embodiments, when the fluid is desired to be introduced into the first flow path 125, the fluid can be introduced via the chamber 118 of the downhole apparatus 103. In other embodiments, the fluid can be introduced from the downhole apparatus 103 into the wellbore after the at least one packer 121 and/or 123 has been set without the need to detect the presence of the fluid with the fluid analyzer 115.

As shown in FIG. 1, when the downhole apparatus 103 is configured to carry out the first operation, the first flow path 125 can be configured to convey a fluid (indicated by arrow 128) from the drill pipe 105 and out a first port 129 located between the first and second packers 121, 123 and the second flow path 127 can be configured to receive a fluid (indicated by arrow 130) from outside the downhole apparatus 103 through a second port 131 located between the first and second packers 121, 123 and convey the fluid 130 to the circulation sub 113. In one embodiment, the first flow path 125 can be in fluid communication with and configured to receive the fluid from the drill pipe 105 and the second flow path 127 can be in fluid communication with and configured to direct the fluid 130 into the circulation sub 113. In another embodiment, the first flow path 125 can be in fluid communication with and configured to receive the fluid from the chamber 118 and the second flow path 127 can be in fluid communication with and configured to direct the fluid 130 into the circulation sub 113. The circulation sub 113 can transfer the fluid 130 through one or more ports 133 to outside the downhole apparatus 103 above the first packer 121. In some embodiments, the fluid 130 conveyed from outside the downhole apparatus 103 can be or can include, but is not limited to, drilling mud, formation fluid, or any other fluid that can be disposed within a wellbore.

In some embodiments, the fluid 128 that can be conveyed out the first port 129 can be a gas, a liquid, or a mixture thereof. As noted above, in some embodiments, the fluid can include one or more solids, e.g., a proppant, that can be slurried, suspended, dispersed, or otherwise disposed within the fluid(s). Illustrative liquids can be or can include, but are not limited to, water, one or more acids, one or more emulsifiers, one or more hydrocarbons, one or more surfactants, one or more tracers, or any mixture thereof. Illustrative gases can be or can include, but are not limited to, carbon monoxide, carbon dioxide, nitrogen, one or more hydrocarbons, or any mixture thereof. Suitable tracers can include any material that can be used to measure fluid movement in a well such as a bead tracer and a radioactive tracer.

Figure 2:
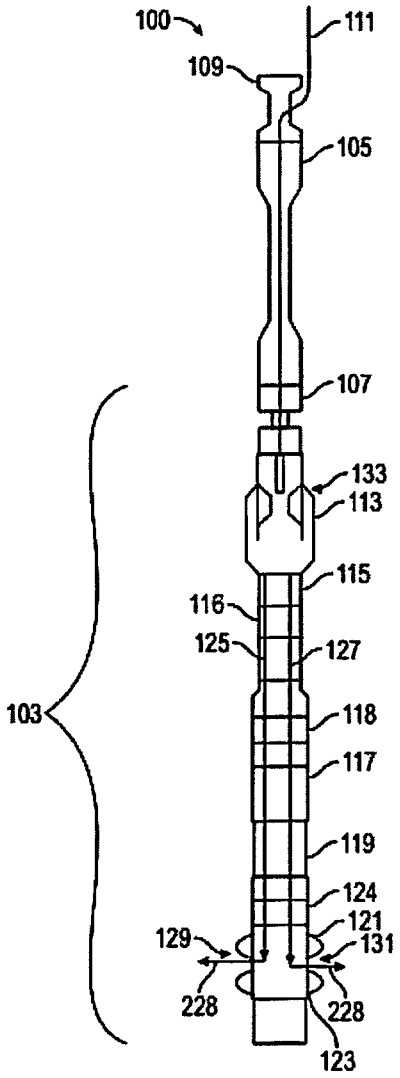
FIG. 2 depicts the down hole assembly shown in FIG. 1 with the downhole apparatus configured to carry out a second operation, according to one or more embodiments described.

FIG. 2 depicts the down hole assembly 100 shown in FIG. 1 with the downhole apparatus 103 configured to carry out a second operation, according to one or more embodiments. In some embodiments, as shown in FIG. 2, when the downhole apparatus 103 is configured to carry out the second operation both the first flow path 125 and the second flow path 127 can be configured to convey a fluid (indicated by arrows 228) from the drill pipe 105 and out the first and second ports 129, 131, respectively, located between the first and second packers 121, 123. In this embodiment, the second flow path 127 can be configured to be in fluid communication with the drill pipe 105 and not in fluid communication with the circulation sub 113, e.g., by actuating valve(s) to place the second flow path 127 into fluid communication with the drill pipe 105. In other embodiments, just the first flow path 125 can be configured to convey the fluid 228 from the drill pipe 105 and out the first port 129, with the second flow path 127 being isolated from the wellbore environment by closing a valve or other isolation device. In some embodiments, the one or more ports 133 of the circulation sub 113 can be fluidly isolated from the wellbore by closing one or more valves or other isolation device. As such, in the second operation the first flow path 125 or the first and second flow paths 125, 127 can be configured to convey the fluid received from the drill pipe 105 or the optional coiled tubing that can be disposed within the drill pipe 105 from the down hole apparatus 103 and into the wellbore such that at least a portion of the fluid 228 can be injected from the downhole apparatus 103 into a geological stratum when the at least one packer 121 and/or 123 is in a set configuration with the downhole apparatus 103 located at a desired station depth within the wellbore.

The downhole apparatus 103 can be configured to carry out the first operation shown in FIG. 1 and then reconfigured while maintained within the wellbore to carry out the second operation. In some embodiments, the downhole apparatus 103 can be configured to carry out multiple first operations, multiple second operations, or a combination of multiple first and second operations in any order or sequence. In some embodiments, water or other fluid can be circulated as in the first operation between each second operation when two or more second operations are carried out at a desired station depth. In other embodiments, two or more second operations can be carried out to inject one or more fluids into a geological stratum at the desired station depth without the first operation being carried out between the two second operations. In some embodiments, the downhole tool 103 can be used to carry out the first operation that can be followed by one or more second operations. When the downhole tool 103 carries out multiple first and/or second operations, a composition of the fluid can be the same or different between any two operations that follow one another. In some embodiments, the downhole apparatus 103 can be used to carry out the first operation to introduce a first fluid, e.g., water, and reconfigured to carry out the second operation to introduce a second fluid, e.g., carbon dioxide, that can be followed by one or more additional second operations to introduce a third, fourth, etc. fluid, e.g., an acid, a surfactant, a caustic, water, etc.

In some embodiments, the quantity or volume of fluid 128 introduced via port 129 from the downhole apparatus 103 and/or the quantity or volume of fluid 228 introduced via port 129 or ports 129 and 131 from the downhole apparatus 103 can be any desired amount. In some embodiments, when the fluid 128, 228 is a liquid the amount of liquid can be at least 23 L, at least 25 L, at least 30 L, at least 40 L, at least 50 L, at least 75 L, at least 100 L, at least 125 L, or at least 150 L. In other embodiments, when the fluid 128, 228 is a liquid the amount or volume of liquid can be at least the volume within the isolated or sealed volume provided via the set packers 121, 123. In some embodiments, when the fluid 128, 228 is a liquid the amount of liquid that can be introduced per day can range from about 8 L to about 17,200 L. In some embodiments, when the fluid 128, 228 is a gas quantity or volume of gas can be at least 10 $m^3$, at least 20 $m^3$, at least 30 $m^3$, at least 40 $m^3$, at least 50 $m^3$, or at least 75 $m^3$ at standard temperature and pressure. In at least one embodiment, for an 8.9 cm inner diameter drill pipe 105, about 25 $m^3$ to about 35 $m^3$, e.g., about 31 $m^3$, of carbon dioxide can be injected via port 129 and/or ports 129, 131. It should be understood that the fluid can be introduced from the downhole apparatus 103 under any desired pressure. In some embodiments, the fluid can be introduced via port 129 or ports 129 and 131 at a pressure that can be between a formation pressure and a pressure within the wellbore. The volume of fluid introduced via port 129 or ports 129, 131 can be introduced at any desired flow rate. In some embodiments, a period of time from starting the introduction of the fluid until the volume of fluid has been introduced and introduction has stopped can be in a range from 30 seconds, 1 minute, 5 minutes, 10 minutes, or 20 minutes to 30 minutes 45 minutes 1 hours, 2 hours, 5 hours, 10 hours, 24 hours, or longer.

Figure 3:
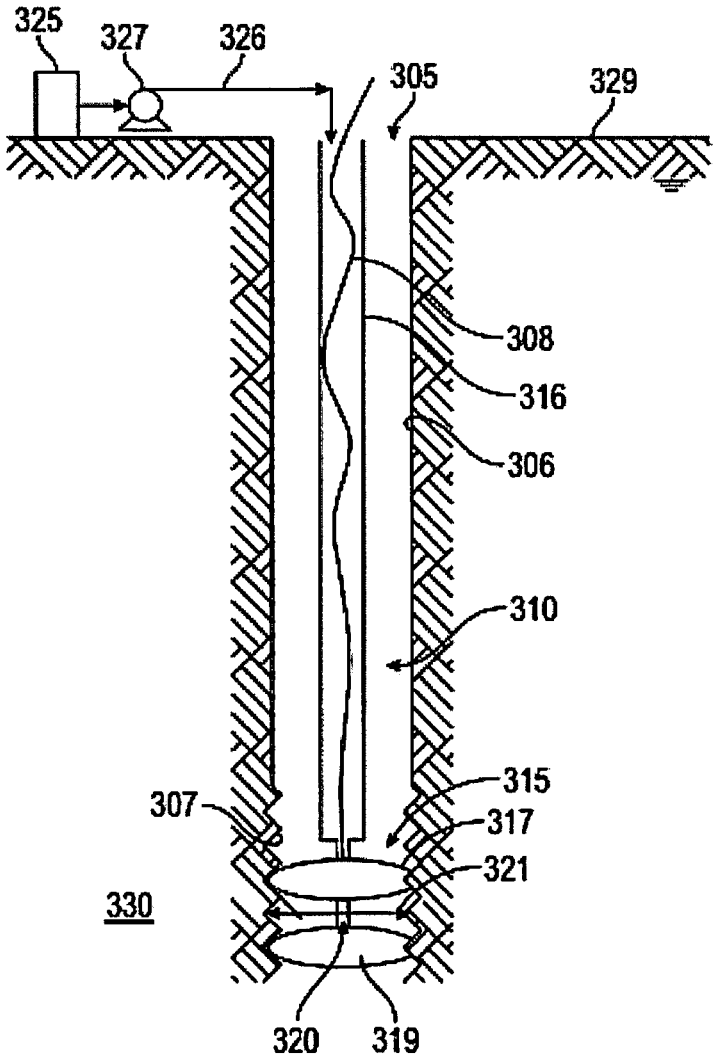
FIG. 3 depicts a cross-section of a wellbore that includes another illustrative downhole assembly that includes another downhole apparatus disposed therein, according to one or more embodiments described.

FIG. 3 depicts a cross-section of a wellbore 305 that includes another illustrative downhole assembly 310 that includes another downhole apparatus 315 disposed therein, according to one or more embodiments. In some embodiments, the downhole apparatus 315 can be the downhole apparatus 103 described above with reference to FIGS. 1 and 2. The downhole apparatus 315 can be positioned on a drill pipe 316 and placed at a desired station depth within the wellbore 305. A cable 308 can be attached to the downhole apparatus 315 from an up-hole environment. As shown, in some embodiments an upper portion of the wellbore 305 can include a casing 306 and a lower portion of the wellbore 305 can be uncased and open to a borehole wall 307.

The downhole apparatus 315 can include at least one packer, two are shown, 317, 319. The first and second packers 317, 319 can be set to provide a sealed space or volume 320 between at least a portion of the downhole apparatus 315 and the borehole wall 307. As shown, a fluid 321 can be injected from the downhole apparatus 315 into a geological stratum 330. The fluid 321 can be introduced from a fluid source 325 via line 326 into the drill pipe 316 (or optional coiled tubing that can be disposed within the drill pipe 316) and introduced to the downhole apparatus 315. In some embodiments, a pump 327 located on a surface of the earth 329 can be used to introduce the fluid 321 into the drill pipe 316 (or the optional coiled tubing). In some embodiments, the pump 327 can be a rig pump. In some embodiments, one or more pumps in the downhole apparatus 315 can be used to introduce the fluid 321 from the downhole apparatus 315 and into the sealed volume 320 and the fluid 321 can flow into the geological stratum 330. In other embodiments, the pump 327 can be used to introduce the fluid 321 into the sealed volume 320 and the fluid 321 can flow into the geological stratum 330. In some embodiments, the downhole apparatus 315 can use a fluid analyzer to detect and confirm the fluid 321 has been introduced thereto via the drill pipe 308 and/or the optional coiled tubing.

In other embodiments, the downhole apparatus 315 can be configured to operate in the first configuration described above with reference to FIG. 1 such that the fluid 321 can be introduced into the sealed volume 320 that can cause a downhole fluid, e.g., drilling mud, within the sealed volume 320 to flow into the downhole apparatus 315 and back into the wellbore 305 above the first packer 317. The injection of the fluid 321 into the sealed volume 320 can be controlled through actuation of downhole pumps in the downhole apparatus 315 and/or the pump 327 located on the surface 329.

In some embodiments, one process can include only injection of a liquid with the downhole apparatus. In other embodiments, one process can include only injection of a gas. In some embodiments, the injection of the liquid and/or the gas can occur through coiled tubing disposed within the drill pipe. In some embodiments, for an 8.9 cm inner diameter pipe drill pipe, about 31 cubic meters of carbon dioxide can be injected. After injection of the liquid or the gas, equilibrium can be reestablished between the drill pipe and the wellbore.

As will be understood, the apparatus and processes disclosed herein can allow for injection of fluids via a drill pipe and/or coiled tubing disposed within the drill pipe to downhole environments from a downhole apparatus attached to the drill pipe. Embodiments provide for using downhole pumps and/or pumps, e.g., one or more rig pumps, located on the surface of the earth to create the injection pressure into the geological stratum. Injection can occur at different stations or elevations within the wellbore. Injection can also include different types of fluids, including liquids, gases, and/or combinations of liquids and gases. Aspects of the disclosure provide for an economical process to inject such fluids.

Upon completion of the process, the packers 317, 319 maintaining the scaled volume 320 can be unset and an equilibrium between the drill pipe 308 and the wellbore can be established. The equilibrium can be established through a control device, such as a series of valves, in one non-limiting embodiment. After this, a new station depth can be selected, the downhole assembly 310 can be moved to the new station depth, and a desired operation can be carried out by the downhole apparatus 315 or the downhole assembly 310 can be removed from the wellbore 305.

Figure 4:
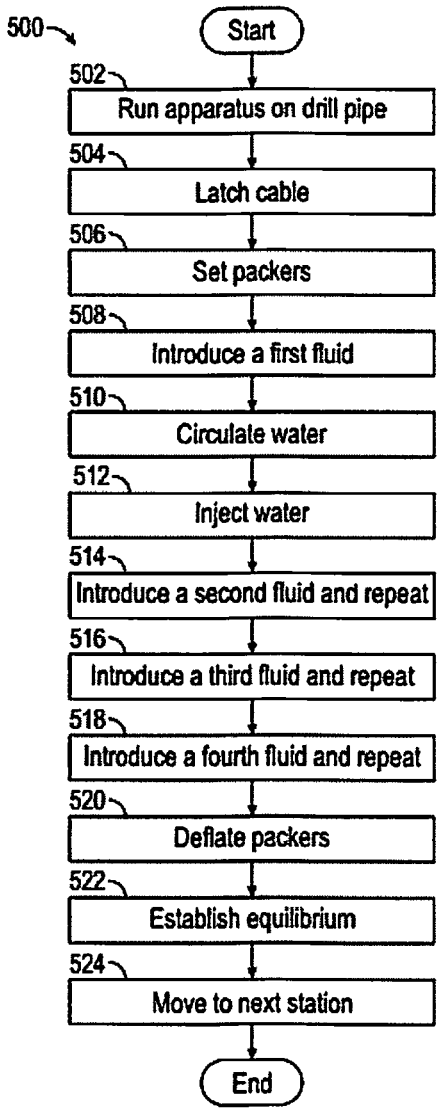
FIG. 4 depicts an illustrative process for injecting a fluid into a geological stratum, according to one or more embodiments described.

FIG. 4 depicts an illustrative process 500 for injecting a fluid into a geological stratum, according to one or more embodiments. The process 500 can include running a downhole apparatus, at 502, on a drill pipe to a station depth. As will be understood, the process 500 may be accomplished by any of the embodiments disclosed in FIGS. 1 to 3. At 504, the process can continue with latching a cable to establish contact between the downhole apparatus and the up-hole environment. At 506, the process can include setting one or more packers to seal an interval between the downhole apparatus and a wellbore wall. At 508, the process can further include introducing a first fluid, e.g., water, at the depth station. In some embodiments, the first fluid can be introduced via the drill pipe or coiled tubing disposed within the drill pipe. Other fluid conveyances may be used; therefore, the description of using a drill pipe or coiled tubing should not be considered limiting. In other embodiments, the first fluid can be obtained from a chamber of the downhole apparatus that contains the first fluid, in one non-limiting embodiment At 510, the process can include circulating water to displace fluids, such as mud within the sealed interval, through the downhole apparatus and out into the wellbore above an upper most set packer. Downhole pumps of the downhole apparatus may be used to perform the circulation in one non-limiting embodiment. In other embodiments, rig pumps can be used to perform the circulation with downhole pumps placed in a bypass (passive) mode. At 512, the process can include injecting water from the drill pipe into the formation using the downhole apparatus. At 514, the process can continue with introducing a second fluid, e.g., carbon dioxide. By way of definition, the term "introducing" includes injecting the fluid into a geological stratum, wellbore or both. In some embodiments, after the second fluid has been introduced, steps 510 and 512 can be repeated. In other embodiments, steps 510 and 512 are not repeated. At 516, the process can continue with introducing a third fluid, e.g., an acid, and optionally repeating as done in 514. At 518, the process can continue with introducing a fourth fluid, e.g., carbon dioxide, and optionally repeating as done in 514. At 520, the process can include deflating the one or more packers. At 522, the process can include establishing an equilibrium between the wellbore and the drill pipe. At 524, the process can continue with moving to a new station depth. As will be understood, in some embodiments, the connection or latching of the cable can be done prior to running the downhole apparatus on the drill pipe to the station depth. As will also be understood, in some embodiments, the connection or latching of the cable can be done after running the downhole apparatus on the drill pipe to the station depth.

Figure 5:
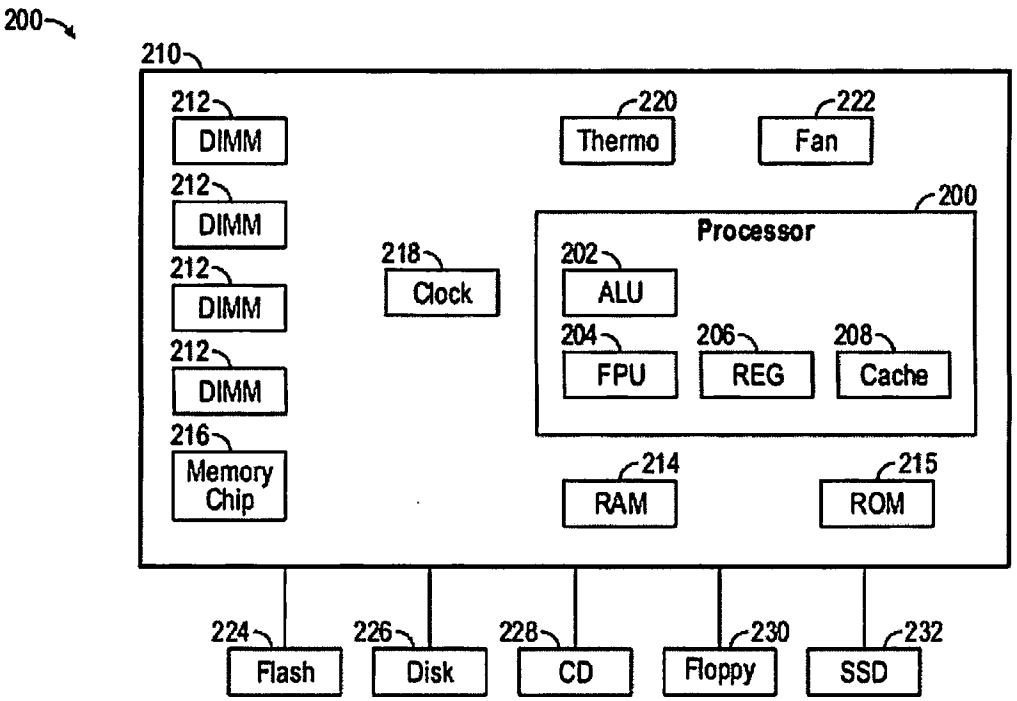
FIG. 5 depicts an illustrative a computer apparatus that can be used in performing processes and controlling a downhole apparatus, according to one or more embodiments described.

FIG. 5 depicts an illustrative a computer apparatus 200 that can be used in performing processes and controlling a downhole apparatus, according to one or more embodiments. In some embodiments, the computer apparatus 200 can be used to control operations of the downhole apparatus 103 and/or 315 described above with reference to FIGS. 1-3. In some embodiments, the processes described herein can be performed by circuits and/or computers that can be configured to perform such tasks. In FIG. 5, a processor 200 can be provided to perform computational analysis for instructions provided. With the instructions provided, code, can be written to achieve the desired goal and the processor 200 can access the instructions. In other embodiments, the instructions can be provided directly to the processor 200.

In other embodiments, other components can be substituted for generalized processors. These specifically designed components, known as application specific integrated circuits ("ASICs") are specially designed to perform the desired task. As such, the ASICs generally have a smaller footprint than generalized computer processors. The ASICs, when used in embodiments of the disclosure, can use field programmable gate array technology, that allows a user to make variations in computing when desired. Thus, the processes described herein are not specifically held to a precise embodiment, rather alterations of the programming can be achieved through these configurations.

In some embodiments, when equipped with a processor 200, the processor 200 can include an arithmetic logic unit ("ALU") 202, a floating point unit ("FPU") 204, registers 206, and a single or multiple layer cache 208. The arithmetic logic unit 202 can perform arithmetic functions as well as logic functions. The floating point unit 204 can be math coprocessor or numeric coprocessor to manipulate numbers more efficiently and quickly than other types of circuits. The registers 206 can be configured to store data that can be used by the processor 200 during calculations and supply operands to the arithmetic logic unit 202 and store the result of operations. The single or multiple layer caches 208 can be provided as a storehouse for data to help in calculation speed by preventing the processor 200 from continually accessing random access memory ("RAM") 214.

Aspects of the disclosure provide for the use of a single processor 200. Other embodiments of the disclosure allow the use of more than a single processor 200. Such configurations can be called a multi-core processor where different functions can be conducted by different processors to aid in calculation speed. In some embodiments, when different processors are used, calculations can be performed simultaneously by different processors, a process known as parallel processing.

The processor 200 can be located on a motherboard 210. The motherboard 210 can be a printed circuit board that incorporates the processor 200 as well as other components helpful in processing, such as memory modules ("DIMMS") 212, random access memory 214, read only memory 215, non-volatile memory chips 216, a clock generator 218 that can keep components in synchronization, as well as connectors for connecting other components to the motherboard 210. The motherboard 210 can have different sizes according to the needs of the computer architect. To this end, the different sizes, known as form factors, can vary in size from a cellular telephone size to a desktop personal computer size. The motherboard 210 can also provide other services to aid in functioning of the processor 200, such as cooling capacity. Cooling capacity can include a thermometer 220 and a temperature-controlled fan 222 that conveys cooling air over the motherboard 210 to reduce temperature.

Data stored for execution by the processor 200 can be stored in several locations, including the random access memory 214, read only memory 215, flash memory 224, computer hard disk drives 226, compact disks 228, floppy disks 230, and/or solid state drives 232. For booting purposes, data can be stored in an integrated chip called an EEPROM, that can be accessed during start-up of the processor 200. The data, known as a Basic Input/Output System ("BIOS"), contains, in some embodiments, an operating system that controls both internal and peripheral components.

Different components can be added to the motherboard 210 or can be connected to the motherboard 210 to enhance processing. Examples of such connections of peripheral components can include video input/output sockets, storage configurations (such as hard disks, solid state disks, or access to cloud-based storage), printer communication ports, enhanced video processors, additional random access memory and network cards.

The processor 200 and motherboard 210 can be provided in a discrete form factor, such as personal computer, cellular telephone, tablet, personal digital assistant, or other component. The processor 200 and motherboard 210 can be connected to other such similar computing arrangement in networked form. Data can be exchanged between different sections of the network to enhance desired outputs. The network can be a public computing network or can be a secured network where only authorized users or devices can be allowed access.

As will be understood, process steps for completion can be stored in the random access memory 214, read only memory 215, flash memory 224, computer hard disk drives 226, compact disks 228, floppy disks 230 and solid state drives 232.

Different input/output devices can be used in conjunction with the motherboard 210 and processor 200. Input of data can be through a keyboard, voice, Universal Serial Bus ("USB") device, mouse, pen, stylus, Firewire, video camera, light pen, joystick, trackball, scanner, bar code reader and touch screen. Output devices can include monitors, printers, headphones, plotters, televisions, speakers and projectors.

Figure 6:
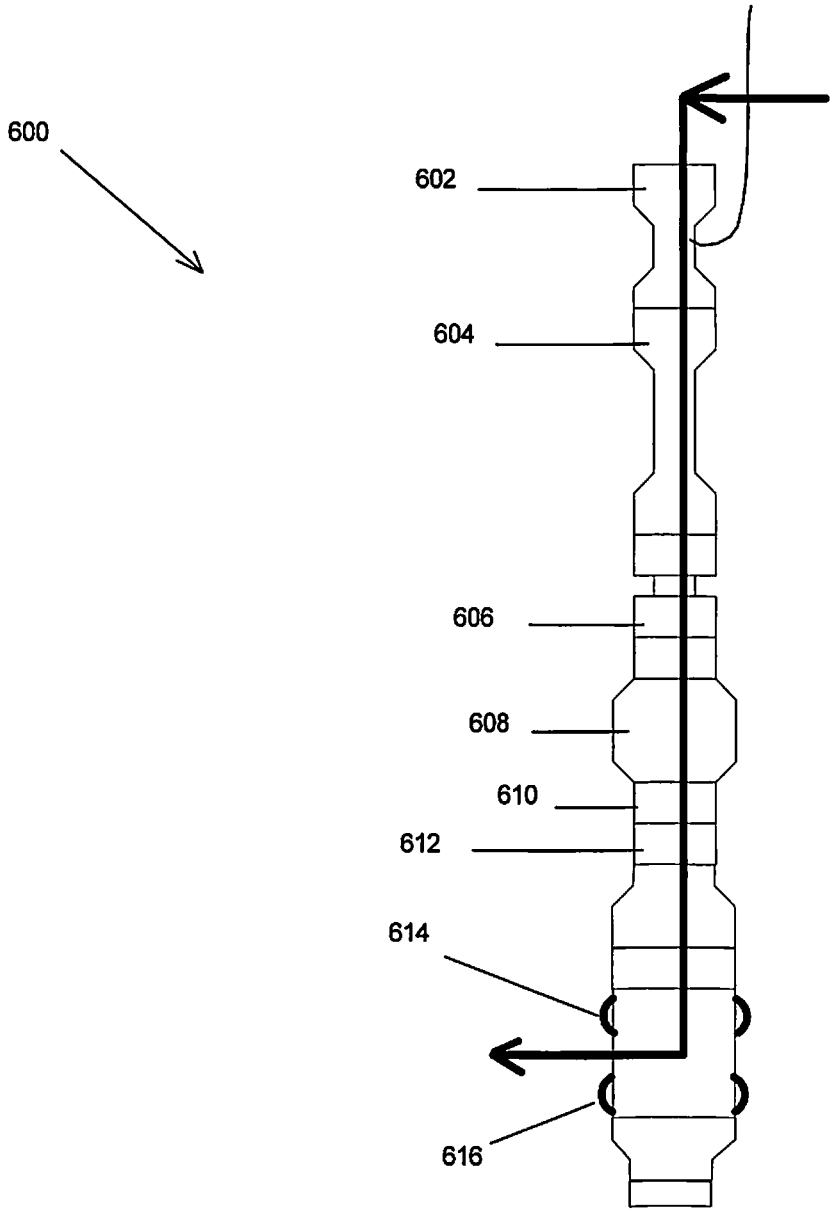
FIG. 6 is a cross-section of a wellbore and tool associated with one example embodiment of the disclosure.
Figure 7:
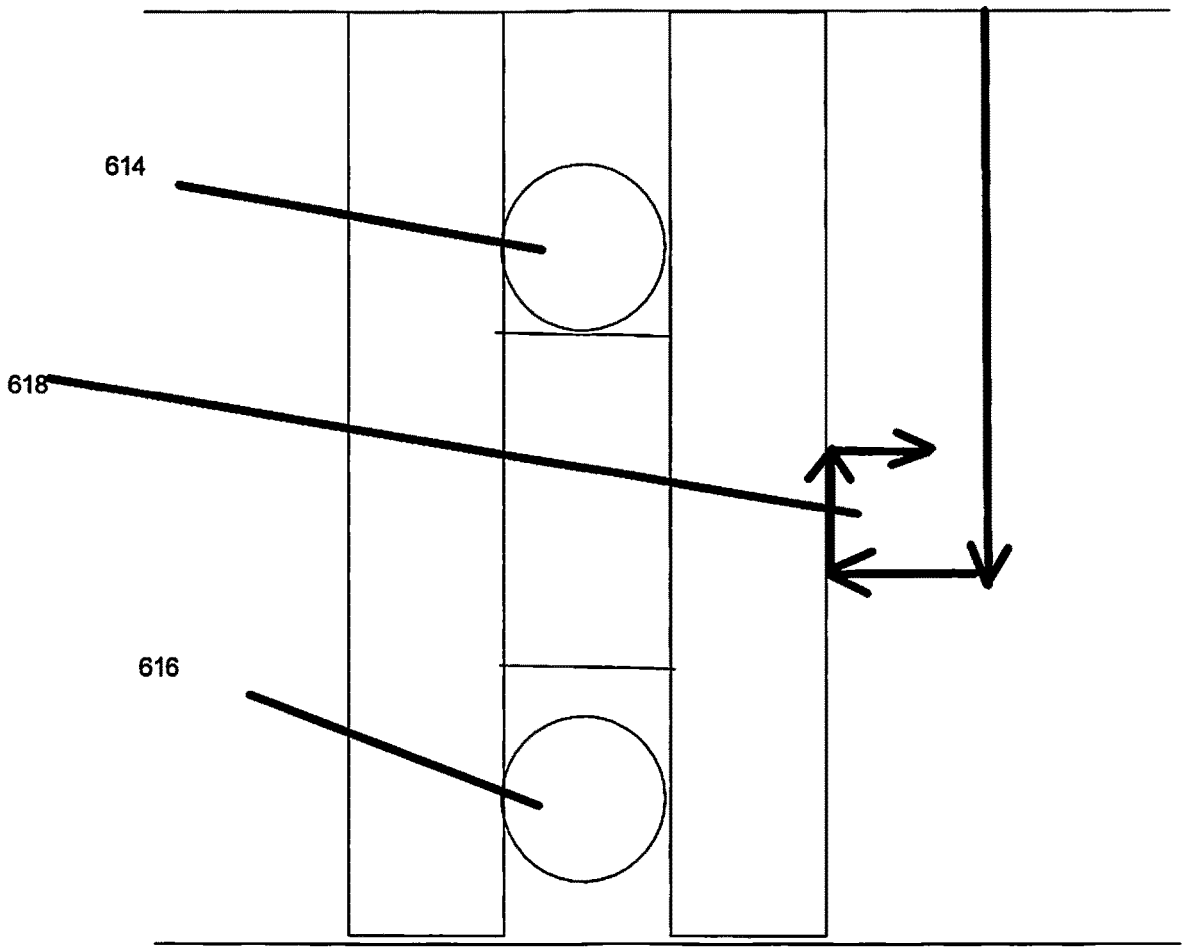
FIG. 7 is a cross-section of a wellbore and tool associated with another example embodiment of the disclosure.
Figure 8:
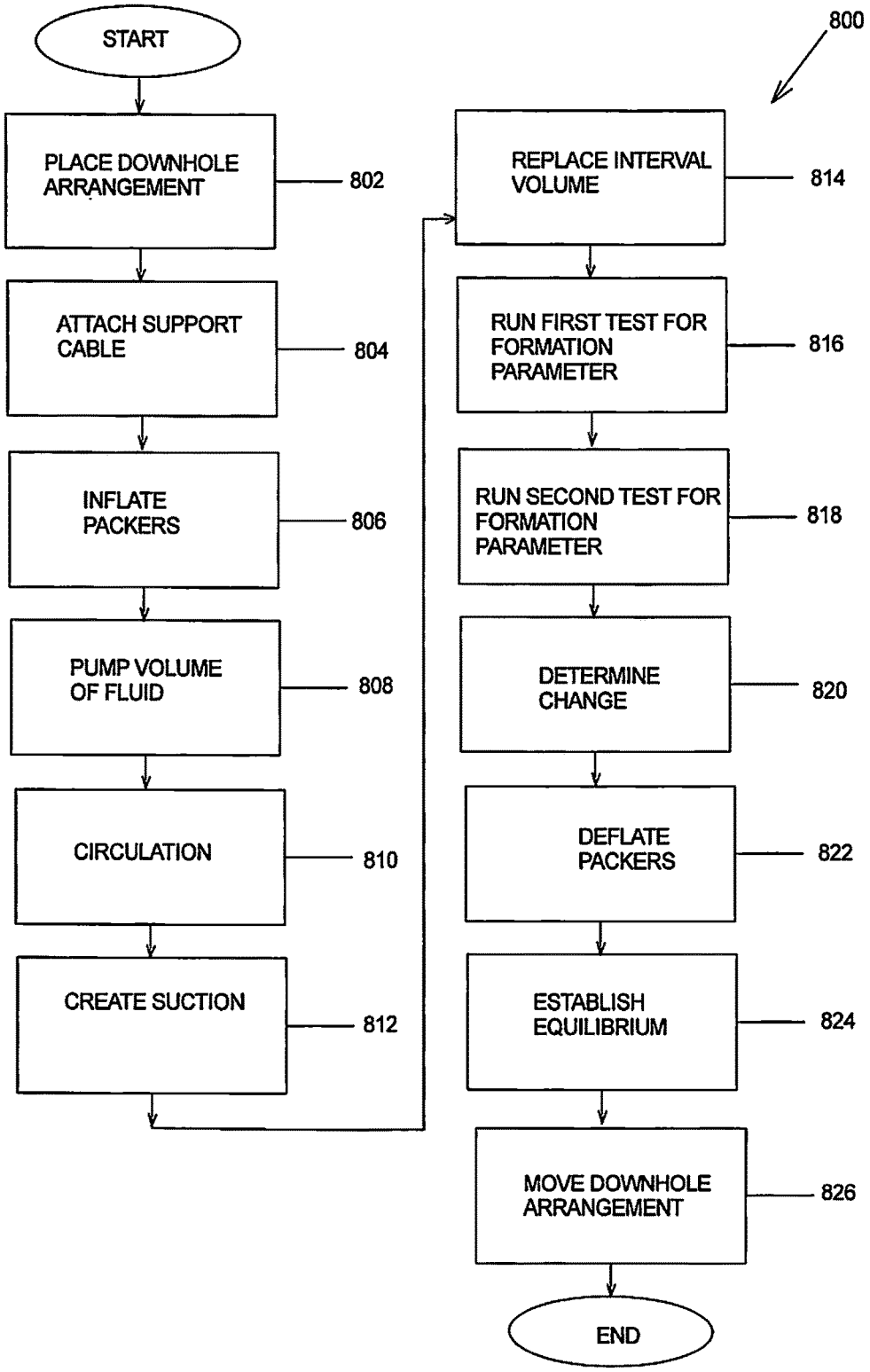
FIG. 8 discloses a process of injection of fluid into a geological stratum and evaluation of the stratum.

In the embodiments presented in FIGS. 6 to 8, an arrangement and process is presented that allows field personnel to determine geological characteristics of downhole stratum. In this embodiment, circulation is different than other described embodiments. An advantage of the arrangement embodiment and process presented herein is that the arrangement is movable and a set of measurements may be made along the entire wellbore. Such a set of measurements may create a log that may be interpreted. Embodiments of the disclosure allow for injection of various fluids into the downhole environment. The downhole arrangement and process described in FIGS. 6 to 8, may be identical to other embodiments described herein, allowing for multiple testing capabilities for the same apparatus. This multi-use capability provides flexibility for field personnel. The flushing capability allows for the clearing of native fluids from around a wellbore. In embodiments, the circulation process disclosed may be different than the previously described processes.

Referring to FIG. 6, an arrangement 600 is disclosed. In this non-limiting embodiment, the arrangement 600 comprises a side entry sub 602, located above drill pipe 604, as well as TLC equipment 606, a circulation sub 608, a tension compression sub 610, and a telemetry cartridge 612. By way definition, TLC equipment 606 relates to tough logging condition equipment that may be exposed to high temperatures, high pressures, vibrations and caustic environments, as non-limiting embodiments. The arrangement 600 may also be configured with a first packer 614 and a second packer 616. Between the first packer 614 and second packer 616 an interval volume 618 is defined. The arrangement 600 may be placed within a wellbore 620 placed into the geological stratum 622.

With the arrangement 600, a fluid may be delivered from the surface using the bottom hole platform described herein. In one embodiment, the fluid delivered may be fresh water. Other embodiments are also possible. In these embodiments, a brine may be delivered. In the embodiments, the delivery of the fluid may be through the drill pipe 604 directly. In other example embodiments, delivery of water from the surface may be through a coiled tubing connected to the drill pipe 604. In the embodiments presented, the amount of fresh water or brine water may be virtually unlimited. The water source may be, for example, from a tank. The tank may be located at a centralized location for several wellbores, or the tank may be carried to the site as part of wireline logging equipment. As will be understood, the larger the borehole, the larger the potential amount of water to be used. Additionally, if large amounts of native fluids must be flushed, larger amounts of water may be necessary to accomplish the objectives. The brine may have different levels of salinity. The brine levels may be mixed and measured at the surface to provide known quantities of fluid. As will be understood, use of different brine levels will allow for different analysis capabilities. In still further embodiments, other markers or tracers may be used. In some embodiments, visual or reactive dyes may be used. As presented before, the fluid to be injected, such as the low salinity brine, is pumped down temporarily at the level of the circulating sub down to the bottom inlet on one line of the tool flowline, while suction of the fluid in the dual packer interval is taking from the upper inlet into the secondary flowline. The fluid in the sump or interval between the dual packer 614, 616 is hence replaced by a fluid to be injected.

The use of brine in differing salinity or with different chemical additives provides a flexibility of use for the field personnel. For example, if the wellbore is subjected to high amounts of groundwater with little hydrocarbons, flushing the surrounding areas with a water would accomplish little. Using a brine that would be different than the encountered fluid downhole; however, allows for field personnel to identify when volumes around the wellbore have been vacated in favor of the injected fluid. Similarly, in some contexts, brine water is pumped downhole in wells for various reasons, including brine water storage. To this end, it would be advantageous for field personnel to use a brine that would be different than what is identified downhole. Having the capability to produce or use a brine that is of a different measurable quantity provides field personnel with the capability to determine when injection is complete.

Various types of brines may be used. These various types of brines may include, but not be limited to calcium chloride, calcium bromide, zinc bromide, and potassium and cesium formate, as non-limiting embodiments. Injection of fluids may be accomplished wherein protections are provided with the arrangement 600 to prevent unwanted fines from infiltrating the interior compartments. Isolation may take the form of using a tight construction and/or using filters throughout the arrangement 600 to remove fines from entering unwanted areas inside the arrangement 600. Systems within the arrangement 600 used for pumping; however, may have the strength and rigidity to pump not only liquids but liquids with fines mixed within the liquid, up to different consistency slurries and non-Newtonian fluids.

Referring to FIG. 7, a cross-section of an exploded view of FIG. 6 is illustrated. The exploded view related to the interval volume located between the packers, located near the bottom of the arrangement 600. In this instance, fluid is taken from between the packers 614, 616. The fluid may be analyzed to determine if the interval between the packers 614, 616 is clean. When the interval volume 618 is clean, then fluid is injected into the stratum. Clean may be defined, in one example embodiment, where the fluid is free from mud.

After injection of fluid into the stratum, further steps may be undertaken to determine geological properties. In one example embodiment, induction calibrated resistivity procedures may be undertaken. Using induction calibrated resistivity, a constant measurement of the salinity of the injected fluid is measured to ensure accurate knowledge of injected fluid salinity and to quantify contamination. During this procedure, an accurate measurement of the volume of injected fluid is made. With wide range pumps, slow and fast rates are easily controllable from surface for the injectivity.

Using resistivity process, physical, chemical and structural properties of the geological stratum 622 may be determined. In embodiments, logs may be created, for analysis by field personnel. Embodiments provide for real-time evaluation or data may be stored and later evaluated. Such evaluations may be performed at the discretion of evaluation personnel.

Referring to FIG. 8, a process 800 in conformance with one example embodiment of the disclosure. The process 800, may include placing a downhole arrangement into a downhole environment to be tested at 802. The placement of the downhole arrangement may be run on drill pipe to an elevation that is desired to be evaluated. Once the downhole arrangement reaches the required elevation, the downhole arrangement may be supported by a latch cable from the top of the downhole arrangement at 804. The process continues, at 806, wherein a pair of packers on the downhole arrangement are inflated, setting the downhole arrangement against a geological stratum. For purposes of illustration, the arrangement 600 in FIG. 6, may be used in accomplishing the process 800 of FIG. 8. As will be understood, other downhole apparatus discussed previously, may be used in conjunction with the process 800 disclosed herein.

The process 800 proceeds, at 808, with pumping a volume of fluid down the downhole arrangement to a circulating sub. At 810, the process continues where at least a portion of the volume of fluid pumped downhole is circulated from the circulating sub to a bottom inlet on one line of an upper inlet into a secondary flowline. At 812, the process continues by creating a suction in a dual packer interval from an upper inlet into a secondary flowline. At 814, the process continues by replacing at least a portion of an interval volume between a first packer and a second packer with at least a portion of the volume of fluid. The fluid that is used to replace the interval volume may be fresh water or a brine. The fresh water or brine may be shaped in a pill type form interspersed within drilling fluid. At 816, the process continues with measuring at least one formation parameter. In other embodiments, the measurement of the at least one formation parameter may be performed earlier in the process. In one example embodiment, the at least one formation parameter may be a saturation parameter. In another example embodiment, a resistivity may be taken. Other possible analysis may be possible and the examples discussed should not be considered limiting. At 818, the process may be further performed wherein a second test of the saturation level of geological stratum at the desired depth. The test may also be another type of geological parameter test, so the description of a saturation level should not be considered limiting. At 820, the process continues with determining a change in the saturation level from the first test to the second test. As will be understood, the second test may also be a different type of geological parameter test to find a difference between the first test and the second test.

In embodiments, the process is continued until the entire interval volume between the first packer and the second packer is replaced. As will also be understood, the measuring may occur at any time desired by field personnel even before the entire interval volume is replaced. This may be done at the discretion of field personnel, wherein if greater accuracy is needed, removing the entire interval volume may be appropriate. If time is of the essence or there is a limitation in the amount of water that is available, then removal of the entire interval volume may not be required. A pump may be used to inject at least a portion of the fluid from the downhole apparatus into a geological stratum at the desired station depth.

At 822, the packers may be deflated. The packers used may be customary downhole packers, as commonly used. The type of packers used; however, may not be limited to such downhole packers. In embodiments, other types of packers may be used, including casing packers, zonal isolation packers, high temperature/high pressure packers, sand control packers if local conditions dictate. Additionally, sampling packers may be used, in embodiments, where it is desired to determine if any leaks are occurring with the sealing of the packers to the wellbore. At 824, equilibrium may be established in the geological stratum to allow for further downhole testing, if necessary. For definitional purposes, equilibrium may be defined as no movement of fluids in the areas desired to be tested. At 826, the process may continue with moving the downhole arrangement to another elevation to perform the process again, if necessary.

Although not discussed above, other remedial measures may be taken at the option of field personnel. For example, after injection and testing/measuring, field personnel may optionally use pumps to remove water or brine injected into the surrounding wellbore, thereby returning the wellbore back to a natural/in situ state. This may be accomplished and have benefits if, for example, a second set of testing is required in a location near the first test location. For the benefits of accuracy, it may be desired to run/perform the process again and check results developed from the first analysis. If, for example, the measurements are not similar, it may be concluded that either the first or second test is incorrect. If, on the other hand, the measurements are similar, a check has been performed, rendering more accuracy for field personnel in determining the required formation parameters. In still further evaluative processes, other checks may be done to verify the accuracy of downhole testing, as provided above. One such evaluation is described, for example, in performing a geological stratum test, the test can be a single point test or can be a continuous log.

The present disclosure further relates to any one or more of the following numbered paragraphs:

Paragraph 1. A process, comprising: positioning a downhole apparatus on a drill pipe; placing the downhole apparatus at a desired station depth within a wellbore; attaching a cable to the downhole apparatus from an up-hole environment; setting at least one packer to seal a space between at least a portion of the downhole apparatus and an inner surface of the wellbore; introducing a fluid to the downhole apparatus through the drill pipe; and using a pump from the downhole apparatus or a pump located at a surface of the earth to inject at least a portion of the fluid from the downhole apparatus into a geological stratum at the desired station depth.

Paragraph 2. The process of paragraph 1, wherein the at least one packer comprises a first packer and a second packer longitudinally spaced apart from one another on the downhole apparatus, and wherein, once set, the first and second packers provide a sealed volume therebetween.

Paragraph 3. The process of paragraph 1 or paragraph 2, wherein the downhole apparatus is a wireline apparatus.

Paragraph 4. The process of any one of paragraphs 1 to 3, where a volume of the fluid injected into the geological stratum is at least at least 23 L, at least 25 L, at least 30 L, at least 35 L, at least 40 L, at least 50 L, at least 60 L, at least 70 L, at least 80 L, at least 90 L, or at least 100 L.

Paragraph 5. The process of paragraph 2 or 3, wherein a volume of the fluid injected into the geological stratum is at least equal the sealed volume provided by the first and second packers once set.

Paragraph 6. The process of any one of paragraphs 1 to 5, wherein the fluid comprises a liquid.

Paragraph 7. The process of paragraph 6, wherein the liquid comprises water.

Paragraph 8. The process of paragraph 6 or 7, wherein the liquid comprises an acid, a proppant, an emulsifier, one or more hydrocarbons, a surfactant, a tracer, or a mixture thereof.

Paragraph 9. The process of any one of paragraphs 1 to 5, wherein the fluid comprises a gas.

Paragraph 10. The process of paragraph 9, wherein the gas comprises carbon dioxide, nitrogen, one or more hydrocarbons, or a mixture thereof.

Paragraph 11. The process of any one of paragraphs 1 to 10, wherein the at least a portion of the fluid is injected into the geological stratum with the pump located at the surface of the earth.

Paragraph 12. The process of any one of paragraphs 1 to 10, wherein the at least a portion of the fluid is injected into the geological stratum with the pump from the downhole apparatus.

Paragraph 13. The process of any one of paragraphs 1 to 12, further comprising detecting the presence of the fluid within the downhole apparatus with a fluid analyzer of the downhole apparatus.

Paragraph 14. A process, comprising: positioning a downhole apparatus on a drill pipe; placing the downhole apparatus at a desired station depth within a wellbore; attaching a cable to the downhole apparatus from an up-hole environment; setting two packers longitudinally spaced apart from one another on the downhole apparatus to provide a sealed volume between the downhole apparatus and an inner surface of the wellbore, wherein the sealed volume comprises a drilling mud, a formation fluid, or a mixture thereof disposed therein; introducing a first fluid to the downhole apparatus through the drill pipe; using a pump from the downhole apparatus or a pump located at a surface of the earth to inject at least a portion of the first fluid from the downhole apparatus into the sealed volume; flowing at least a portion of the drilling mud, the formation fluid, or the mixture thereof from the sealed volume into the downhole apparatus; and introducing the at least a portion of the drilling mud, the formation fluid, or the mixture thereof into the wellbore at a location located between a surface of the earth and the packer closest to the surface of the earth such that the sealed volume contains less of the drilling mud, the formation fluid, or the mixture thereof disposed therein.

Paragraph 15. The process of paragraph 14, further comprising: introducing a second fluid to the downhole apparatus through the drill pipe; using the pump from the downhole apparatus or the pump located at a surface of the earth to inject at least a portion of the second fluid from the downhole apparatus into a geological stratum at the desired station depth.

Paragraph 16. The process of paragraph 15, wherein the first fluid comprises a liquid, and wherein the second fluid comprises a gas.

Paragraph 17. The process of paragraph 15, wherein the first fluid comprises water, and wherein the second fluid comprises an acid, a proppant, an emulsifier, one or more hydrocarbons, a surfactant, a tracer, carbon dioxide, nitrogen, or a mixture thereof.

Paragraph 18. The process of any one of paragraphs 15 to 17, wherein the pump from the downhole apparatus is used to inject the at least a portion of the first fluid from the downhole apparatus into the sealed volume, and wherein the pump located at a surface of the earth is used to inject the at least a portion of the second fluid from the downhole apparatus into the geological stratum.

Paragraph 19. The process of any one of paragraphs 14 to 18, wherein the downhole apparatus is a wireline apparatus.

Paragraph 20. The process of any one of paragraphs 15 to 19, where a volume of the second fluid injected into the geological stratum is at least 23 L, at least 25 L, at least 30 L, at least 35 L, at least 40 L, at least 50 L, at least 60 L, at least 70 L, at least 80 L, at least 90 L, or at least 100 L.

Paragraph 21. The process of any one of paragraphs 15 to 19, wherein a volume of the second fluid injected into the geological stratum is at least equal the sealed volume provided by the first and second packers once set.

Paragraph 22. The process of any one of paragraphs 15 to 21, further comprising detecting the presence of the first fluid and the second fluid within the downhole apparatus with a fluid analyzer of the downhole apparatus.

Paragraph 23. A process, comprising: positioning a downhole apparatus on a drill pipe; placing the downhole apparatus at a desired station depth within a wellbore; attaching a cable to the downhole apparatus from an up-hole environment; setting two packers longitudinally spaced apart from one another on the downhole apparatus to provide a sealed volume between the downhole apparatus and an inner surface of the wellbore, wherein the sealed volume comprises a drilling mud, a formation fluid, or a mixture thereof disposed therein; using a pump from the downhole apparatus to inject at least a portion of a first fluid from the downhole apparatus into the sealed volume, wherein the first fluid is obtained from a chamber of the downhole apparatus that contains the first fluid; flowing at least a portion of the drilling mud, the formation fluid, or the mixture thereof from the sealed volume into the downhole apparatus; and introducing the at least a portion of the drilling mud, the formation fluid, or the mixture thereof into the wellbore at a location located between a surface of the earth and the packer closest to the surface of the earth such that the sealed volume contains less of the drilling mud, the formation fluid, or the mixture thereof disposed therein.

Paragraph 24. The process of paragraph 23, further comprising: introducing a second fluid to the downhole apparatus through the drill pipe; using the pump from the downhole apparatus or the pump located at a surface of the earth to inject at least a portion of the second fluid from the downhole apparatus into a geological stratum at the desired station depth.

Paragraph 25. The process of paragraph 24, wherein the first fluid comprises a liquid, and wherein the second fluid comprises a gas.

Paragraph 26. The process of paragraph 24, wherein the first fluid comprises water, and wherein the second fluid comprises an acid, a proppant, an emulsifier, one or more hydrocarbons, a surfactant, a tracer, carbon dioxide, nitrogen, or a mixture thereof.

Paragraph 27. The process of any one of paragraphs 24 to 26, wherein the pump from the downhole apparatus is used to inject the at least a portion of the first fluid from the downhole apparatus into the sealed volume, and wherein the pump located at a surface of the earth is used to inject the at least a portion of the second fluid from the downhole apparatus into the geological stratum.

Paragraph 28. The process of any one of paragraphs 23 to 27, wherein the downhole apparatus is a wireline apparatus.

Paragraph 29. The process of any one of paragraphs 24 to 28, where a volume of the second fluid injected into the geological stratum is at least 23 L.

Paragraph 30. The process of any one of paragraphs 24 to 28, wherein a volume of the second fluid injected into the geological stratum is at least equal the sealed volume provided by the first and second packers once set.

Paragraph 31. The process of any one of paragraphs 24 to 30, further comprising detecting the presence of the second fluid within the downhole apparatus with a fluid analyzer of the downhole apparatus.

Paragraph 32. In another example embodiment, a process is disclosed. The process may comprise positioning a downhole apparatus on a drill pipe and placing the downhole apparatus at a desired station depth within a wellbore. The process may also comprise attaching a cable to the downhole apparatus from an up-hole environment. The process may also comprise performing a first test of a saturation level of geological stratum at the desired station depth. The process may further comprise setting a dual packer to seal a space between at least a portion of the downhole apparatus and an inner surface of the wellbore. The process may further comprise introducing a fluid to the downhole apparatus through the drill pipe, wherein the fluid includes both a drill fluid and one of a fresh water volume and a brine volume, the one of the fresh water volume and the brine volume in a pill. The process may also comprise circulating at least a portion of the fresh water volume and the brine volume through a first line from a circulating sub to a bottom outlet. The process may also comprise creating a suction in a dual packer interval from an upper inlet into a secondary flowline. The process may further comprise replacing at least a portion of fluid from the dual packer interval with the portion of fresh water volume and brine volume. The process may also comprise using a pump to inject at least a portion of the fluid from the downhole apparatus into a geological stratum at the desired station depth. The process may also comprise performing a second test of the saturation level of geological stratum at the desired depth. The process may also comprise determining a change in the saturation level from the first test to the second test. The process may also comprise using a pump to inject at least a portion of the fluid pill located in the wellbore annulus using the downhole apparatus into a geological stratum at the desired station depth. The saturation measurement is not necessarily made with technologies combined with the apparatus to make the injection. It can be combined or it can be run in a separate run to make the saturation measurement.

Paragraph 33. In embodiments, the process of paragraph 32 may be performed wherein the wellbore is an open-hole environment.

Paragraph 34. In embodiments, the process of paragraph 32 may be performed wherein the wellbore is a cased-hole environment.

Paragraph 35. In embodiments, the process of paragraph 32 may be performed wherein the downhole apparatus is a wireline apparatus.

Paragraph 36. In embodiments, the process of paragraph 32 may be performed wherein the fluid is one of a liquid and slurry.

Paragraph 37. In embodiments the process of paragraphs 32 to 36 may be performed wherein the fluid may comprise an acid, a proppant, an emulsifier, one or more hydrocarbons, a surfactant, a tracer, carbon dioxide, nitrogen, or a mixture thereof.

Paragraph 38. In embodiments, the process of paragraph 32 may be performed wherein the at least a portion of the fluid is injected with a pump located at earth's surface.

Paragraph 39. In embodiments, the process of paragraph 32 may be performed wherein the at least a portion of the fluid is injected with a pump in the downhole apparatus.

Paragraph 40 In another embodiment, a process is described. The process may comprise positioning a downhole apparatus on a drill pipe. The process may further comprise placing the downhole apparatus at a desired station depth within a wellbore. The process may further comprise attaching a cable to the downhole apparatus from an up-hole environment. The process may further comprise performing a first geological stratum test at the desired station depth. The process may further comprise setting a dual packer to seal a space between at least a portion of the downhole apparatus and an inner surface of the wellbore. The process may further comprise introducing a fluid to the downhole apparatus through the drill pipe, wherein the fluid includes both a drill fluid and one of a fresh water volume and a brine volume, the one of the fresh water volume and the brine volume in a pill. The process may also comprise circulating at least a portion of the fresh water volume and the brine volume through a first line from a circulating sub to a bottom outlet. The process may also comprise creating a suction in a dual packer interval from an upper inlet into a secondary flowline. The process may also comprise replacing at least a portion of fluid from the dual packer interval with the portion of fresh water volume and brine volume. The process may also comprise using a pump to inject at least a portion of the fluid from the downhole apparatus into a geological stratum at the desired station depth. The process may also comprise performing a second geological stratum test at the desired station depth and determining a change from the first test to the second test.

Paragraph 41. In another example embodiment, the process of paragraph 40 may be performed, wherein the dual packer comprises at least a first packer and a second packer longitudinally spaced apart from one another on the downhole apparatus, and wherein, once set, the first and second packers provide a sealed volume therebetween.

Paragraph 42. In another example embodiment, the process of paragraph 40 may be performed wherein the downhole apparatus is a wireline apparatus.

Paragraph 43. In another example embodiment, the process of paragraph 40 may be performed wherein a volume of the fluid injected into the geological stratum is at least 23 L.

Paragraph 44. In another example embodiment, the process of paragraph 40 may be performed wherein the fluid is a liquid.

Paragraph 45. In another example embodiment, the process of paragraph 40 may be performed wherein the at least a portion of the fluid is injected with a pump located at earth's surface.

Paragraph 46. In another example embodiment, the process of paragraph 40 may be performed wherein the at least a portion of the fluid is injected with a pump in the downhole apparatus.

Paragraph 47. In another example embodiment, the process of paragraph 40 may be performed wherein the liquid comprises at least one of an acid, a proppant, an emulsifier, one or more hydrocarbons, a surfactant, a tracer, or a mixture thereof.

Paragraph 48. In another example embodiment, the process of paragraph 40 may be performed wherein the fluid further comprises a gas.

Paragraph 49. In another example embodiment, the process of paragraph 48 may be performed wherein the gas is an inert gas.

Paragraph 50. In another example embodiment, the process of paragraph 48 may be performed wherein the inert gas is one of carbon dioxide and nitrogen.

Paragraph 51. In another example embodiment, the process of paragraph 48 may be performed wherein the gas comprises one or more hydrocarbons.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same can be varied in many ways. Such variations are not to be regarded as a departure from the disclosure, and all such modifications are intended to be included within the scope of the disclosure.

Certain embodiments and features have been described using a set of numerical upper limits and a set of numerical lower limits. It should be appreciated that ranges including the combination of any two values, e.g., the combination of any lower value with any upper value, the combination of any two lower values, and/or the combination of any two upper values are contemplated unless otherwise indicated. Certain lower limits, upper limits and ranges appear in one or more claims below. All numerical values are "about" or "approximately" the indicated value, and take into account experimental error and variations that would be expected by a person having ordinary skill in the art.

Various terms have been defined above. To the extent a term used in a claim can be not defined above, it should be given the broadest definition persons in the pertinent art have given that term as reflected in at least one printed publication or issued patent. Furthermore, all patents, test procedures, and other documents cited in this application are fully incorporated by reference to the extent such disclosure can be not inconsistent with this application and for all jurisdictions in which such incorporation can be permitted.

While certain preferred embodiments of the present invention have been illustrated and described in detail above, it can be apparent that modifications and adaptations thereof will occur to those having ordinary skill in the art. It should be; therefore, expressly understood that such modifications and adaptations may be devised without departing from the basic scope thereof, and the scope thereof can be determined by the claims that follow.

What is claimed is:

1. A process, comprising:

placing the downhole apparatus at a desired station depth within a wellbore;

attaching a cable to the downhole apparatus from an up-hole environment;

performing a first test of a saturation level of geological stratum at the desired station depth;

setting a dual packer to seal a space between at least a portion of the downhole apparatus and an inner surface of the wellbore;

introducing a fluid to the downhole apparatus through the drill pipe;

circulating at least a portion of the fluid through a first line from a circulating sub to a bottom outlet;

creating a suction in a dual packer interval from an upper inlet into a secondary flowline, using a pump located in the apparatus and in fluid communication with the secondary flowline;

replacing at least a portion of fluid from the dual packer interval with the portion of fluid circulated;

using a pump to inject at least a portion of the fluid from the downhole apparatus into a geological stratum at the desired station depth;

performing a second test of the saturation level of geological stratum at the desired depth; and determining a change in the saturation level from the first test to the second test.

2. The process according to claim 1, wherein the wellbore is an open-hole environment.

3. The process according to claim 1, wherein the wellbore is a cased-hole environment.

4. The process according to claim 1, wherein the downhole apparatus is a wireline apparatus.

5. The process according to claim 1, wherein the fluid is one of a liquid and slurry.

6. The process according to claim 1, wherein the fluid may comprise an acid, a proppant, an emulsifier, one or more hydrocarbons, a surfactant, a tracer, carbon dioxide, nitrogen, or a mixture thereof.

7. The process according to claim 1, wherein the at least a portion of the fluid is injected with a pump located at earth's surface.

8. The process according to claim 1, wherein the at least a portion of the fluid is injected with a pump in the downhole apparatus.

9. A process, comprising:

positioning a downhole apparatus on a drill pipe;

placing the downhole apparatus at a desired station depth within a wellbore;

attaching a cable to the downhole apparatus from an up-hole environment;

performing a first geological stratum test at the desired station depth;

setting a dual packer to seal a space between at least a portion of the downhole apparatus and an inner surface of the wellbore;

introducing a fluid to the downhole apparatus through the drill pipe, wherein the fluid includes both a drill fluid and one of a fresh water volume and a brine volume, the one of the fresh water volume and the brine volume in a pill;

circulating at least a portion of the fresh water volume and the brine volume through a first line from a circulating sub to a bottom outlet;

creating a suction in a dual packer interval from an upper inlet into a secondary flowline;

replacing at least a portion of fluid from the dual packer interval with the portion of fresh water volume and brine volume;

using a pump located on the downhole apparatus to inject at least a portion of the fluid from the downhole apparatus into a geological stratum at the desired station depth;

performing a second geological stratum test at the desired station depth; and determining a change from the first test to the second test.

10. The process according to claim 9, wherein the dual packer comprises at least a first packer and a second packer longitudinally spaced apart from one another on the downhole apparatus, and wherein, once set, the first and second packers provide a sealed volume therebetween.

11. The process according to claim 9, wherein the downhole apparatus is a wireline apparatus.

12. The process according to claim 9, where a volume of the fluid injected into the geological stratum is at least 23 L.

13. The process according to claim 9, wherein the fluid is a liquid.

14. The process according to claim 9, wherein the at least a portion of the fluid is injected with a pump located at earth's surface.

15. The process according to claim 9, wherein the at least a portion of the fluid is injected with a pump in the downhole apparatus.

16. The process according to claim 9, wherein the liquid comprises at least one of an acid, a proppant, an emulsifier, one or more hydrocarbons, a surfactant, a tracer, or a mixture thereof.

17. The process according to claim 9, wherein the fluid further comprises a gas.

18. The process according to claim 17, wherein the gas is an inert gas.

19. The process according to claim 17, wherein the inert gas is one of carbon dioxide and nitrogen.

20. A process, comprising:

placing the downhole apparatus at a desired station depth within a wellbore;

attaching a cable to the downhole apparatus from an up-hole environment;

performing a first geological stratum test at the desired station depth;

setting a dual packer to seal a space between at least a portion of the downhole apparatus and an inner surface of the wellbore;

introducing a fluid to the downhole apparatus through the drill pipe, wherein the fluid includes both a drill fluid and one of a fresh water volume and a brine volume, the one of the fresh water volume and the brine volume in a pill;

circulating at least a portion of the fresh water volume and the brine volume through a first line from a circulating sub to a bottom outlet;

creating a suction in a dual packer interval from an upper inlet into a secondary flowline;

replacing at least a portion of fluid from the dual packer interval with the portion of fresh water volume and brine volume;

using a pump in the downhole apparatus to inject at least a portion of the fluid from the downhole apparatus into a geological stratum at the desired station depth;

performing a second geological stratum test at the desired station depth during presence of the pill at a site of the stratum test; and determining a change from the first test to the second test.

* * * * *